United States Patent [19]

Scarpi

[11] 3,972,200

[45] Aug. 3, 1976

[54] TUNNELLING AND LINING MACHINE

[76] Inventor: Bruno Scarpi, Kerventec, Penthievre, Saint-Pierre-de-Quiberon, France

[22] Filed: Sept. 16, 1974

[21] Appl. No.: 506,312

[30] Foreign Application Priority Data

Sept. 20, 1973 France ..... 73.33697

[52] U.S. Cl. ..... 61/84; 61/45 R

[51] Int. Cl.[2] ..... E01G 5/08

[58] Field of Search ..... 61/85, 84, 45 R, 42, 61/41 R; 29/477.3

[56] References Cited

UNITED STATES PATENTS

| | | | |
|---|---|---|---|
| 3,508,317 | 4/1970 | Hill et al. | 29/477.3 |
| 3,590,590 | 7/1971 | Vujasingvic | 61/85 |
| 3,603,100 | 9/1971 | Cowley | 61/84 |
| 3,850,000 | 11/1974 | McBean | 61/45 R |

*Primary Examiner*—Jacob Shapiro

*Attorney, Agent, or Firm*—Merriam, Marshall, Shapiro & Klose

[57] ABSTRACT

A tunnelling and lining machine has means mounted on it for lining the circular-section tunnel which it excavates with a helical winding of a flexible band, fed from a reel on the structure of the machine by an ejector following a circular path around the longitudinal center axis of the machine. Control of the speed of rotation of the ejector, and of its position along the longitudinal direction of the machine, are provided for so as to allow the turns of the helical winding to be applied at a desired constant relationship irrespective of the speed of excavation. Drive means for positioning the ejector longitudinally and for rotating it may be in common. The ejector expels the band by means of rollers some of which may have the function of giving the band which was flat when stored on the reel, a shaped cross-sectional profile. A reloading drive is provided for the reel.

8 Claims, 12 Drawing Figures

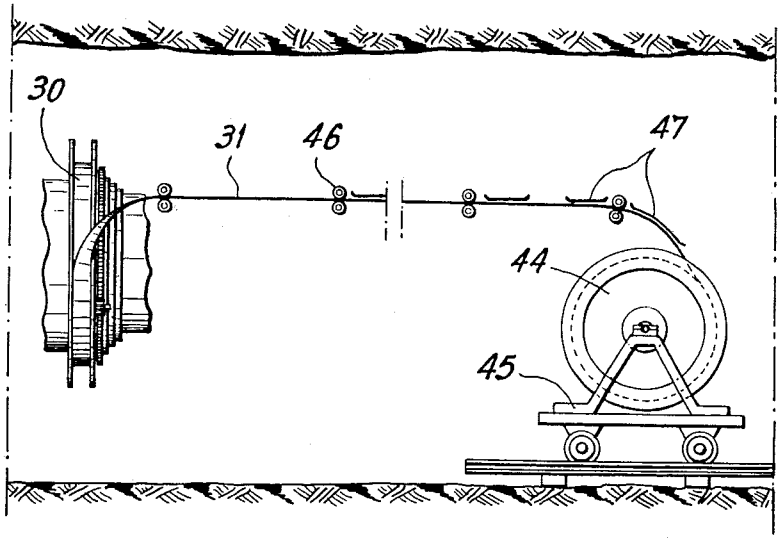
Fig. 7
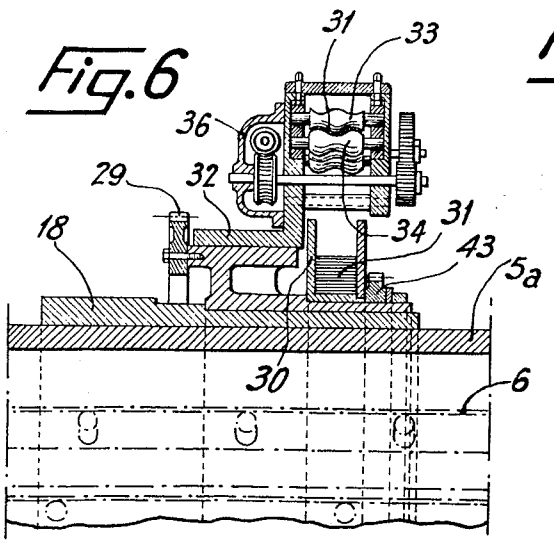
Fig. 6
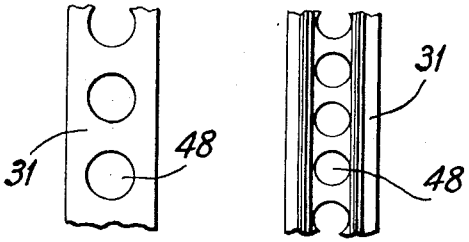
Fig. 9a
Fig. 9b
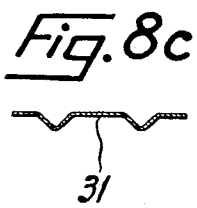
Fig. 8c
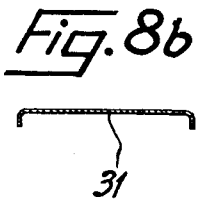
Fig. 8b
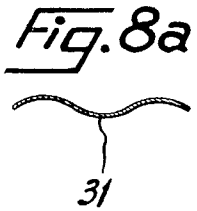
Fig. 8a

TUNNELLING AND LINING MACHINE

FIELD OF THIS INVENTION

The present invention concerns tunnelling and lining machines intended for the excavation of approximately circularsection underground tunnels.

BACKGROUND OF THE INVENTION

Machines are known for excavating underground tunnels which include at least one digging head mounted at the front of a structure provided with means for intermittent advance, so as to progress at the pace of the excavation of the tunnel. Generally this structure is tubular and surrounds an internal conveyor allowing the spoil to be taken away to the rear.

In ground which is soft or only moderately hard, it is necessary to place a lining for the walls of the tunnel behind the excavation machine so as to protect the people working there against falls. In practice such a lining is made up of discontinuous elements such as arches, centerings, or plates put in place and assembled as soon as there is room. Carrying out this lining is therefore done in discontinuous stages and since it is difficult to do the lining work while the machine is operating, the latter must be stopped frequently so as not to leave too great a length of the tunnel unlined. Moreover it is of its nature that the positioning of the lining is carried out when the men working at it are unprotected.

SUMMARY OF THE INVENTION

The invention is concerned with improvements in machines of the abovementioned type which allow the positioning of lining in a tunnel in course of construction in a continuous manner and without stopping the machine. Moreover the positioning of this lining can be carried out very close to the digging head of the machine so that no part of the cylindrical wall of the newly excavated tunnel remains without lining.

To this end, according to the present invention, a tunnelling machine includes, mounted on the rear portion of the tubular structure supporting the digging head, a mechanism which covers the wall of the tunnel during the course of excavation with a helical winding, concentric with the tunnel and formed by a flexible band. This band may be of metal and perforate or imperforate.

Advantageously the said mechanism includes a rotor which is concentric with the said structure and which includes an ejector taking the band from a reel and pushing it towards the wall of the tunnel so as to form turns which are substantially normal to the axis of the said structure. The reel may be mounted idly on the rear portion of the structure in such a way that its axis is identical with the axis of the structure, the ejector then describing a circular path lying between the reel and the wall of the tunnel. In order that the band shall be pressed continuously against the said wall, it is desirable that the speed of rotation of the ejector round the axis of the structure shall tend to be slightly less than the speed at which the band is fed out by the ejector.

Preferably, the said ejector is made up of at least one pair of cooperating rotatable drive rollers between which the band is pressed. The band stored on the reel may be planar in cross section and the ejector may include at least one pair of forming rollers which impose on the band passing between them a shaped profile such as ribbed, wavy or channeled cross-section. The drive rollers may be the forming rollers.

If the speed of the rotor were constant and it moved longitudinally with the digging head, the pitch of the turns formed by the band would depend strongly on the progress of the tunnelling machine. Thus, if the speed of progress of the machine varies due, for example, to different hardnesses of ground encountered by the digging head, the pitch of the helix is not constant.

It is therefore preferable for the speed of rotation of the rotor to be variable and for the rotor and the reel to be mounted on a slide, acting on the rear portion of the structure and being slidable on the latter parallel to its longitudinal axis. Thus, in controlling the displacement of the slider relative to the structure as well as the speed of the rotor, variations in the progress of the machine may be compensated for and a helix of constant pitch be obtained. It is obvious that adjacent turns of this helix may overlap or touch at their lateral edges, or not, as desired.

Preferably, the sliding movement of the slider relative to the structure and the rotational movement of the rotor relative to the slider are controlled by a single drive system borne by the slider.

This drive system may include a motor and a speed-reducer, as well as a controllable clutch between the motor and the speed-reducer.

The slider can be operatively linked to the structure by a worm system controlled by the said drive apparatus and meshing it with a rack fixed on the structure, parallel to the axis of the latter. Control of the rotation of the worm can be by means of a variable ratio transmission, to get control of the pitch of the helical winding.

The mechanical link between the slider and the rotor can be carried out by a pinion driven by the drive apparatus and meshing with a toothed ring fast with the rotor.

A particular embodiment of the invention will now be described with reference to the accompanying drawings.

DESCRIPTION OF THE DRAWINGS

FIG. 6 is a cross section on the line VI—VI of FIG. 4, FIG. 7 shows schematically the reloading of the machine of FIG. 1 from a reel on which is wound a sheet metal band destined for lining, FIGS. 8*a*, 8*b* and 8*c* show schematically three different sections for the sheet metal lining band, FIGS. 9*a* and 9*b* show, in plan view, portions of sheet metal lining bands.

DESCRIPTION OF A PREFERRED EMBODIMENT

Figure 1:
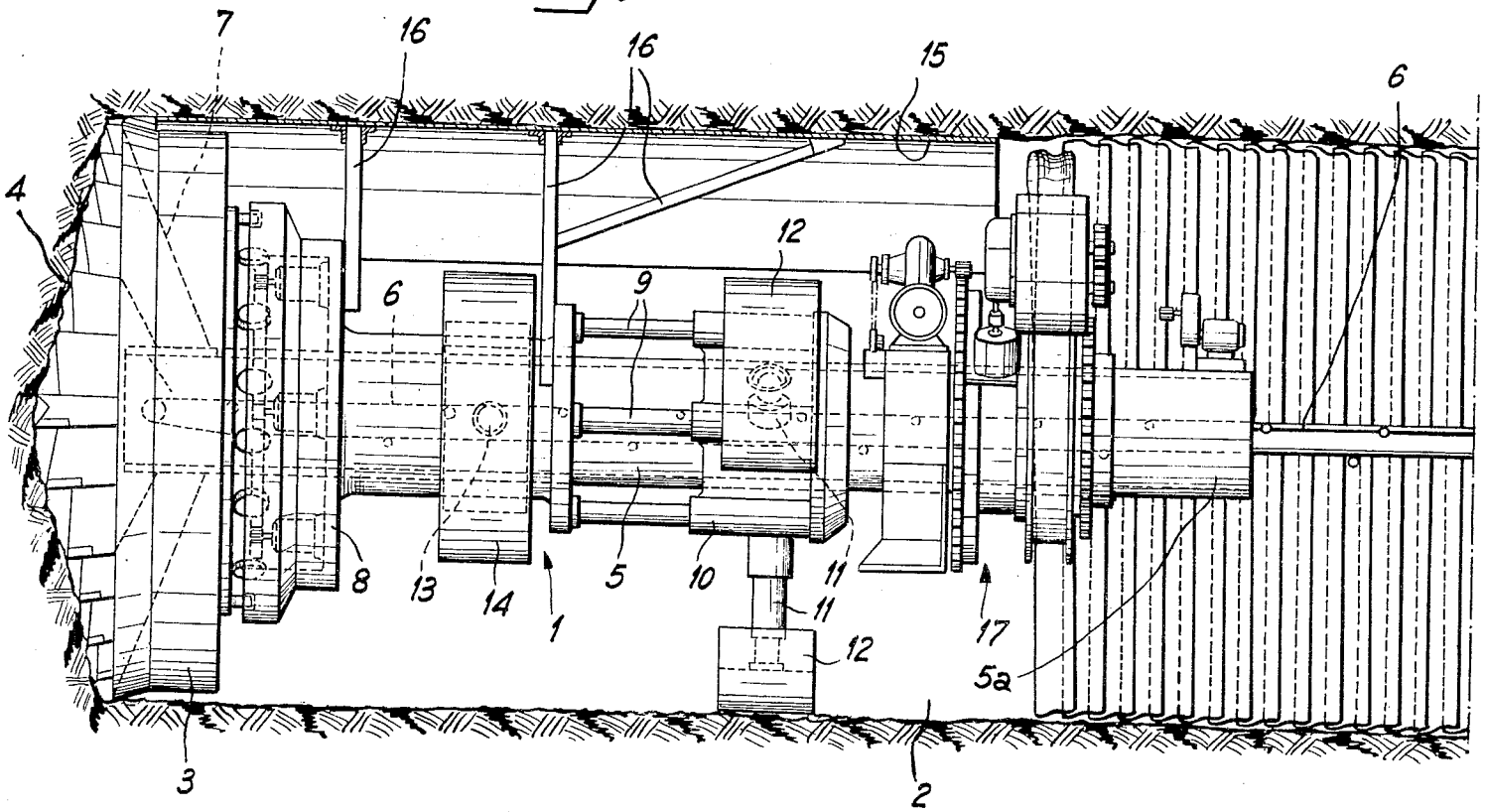
FIG. 1 is a schematic elevation of a tunnelling machine embodying the invention.
Figure 2:
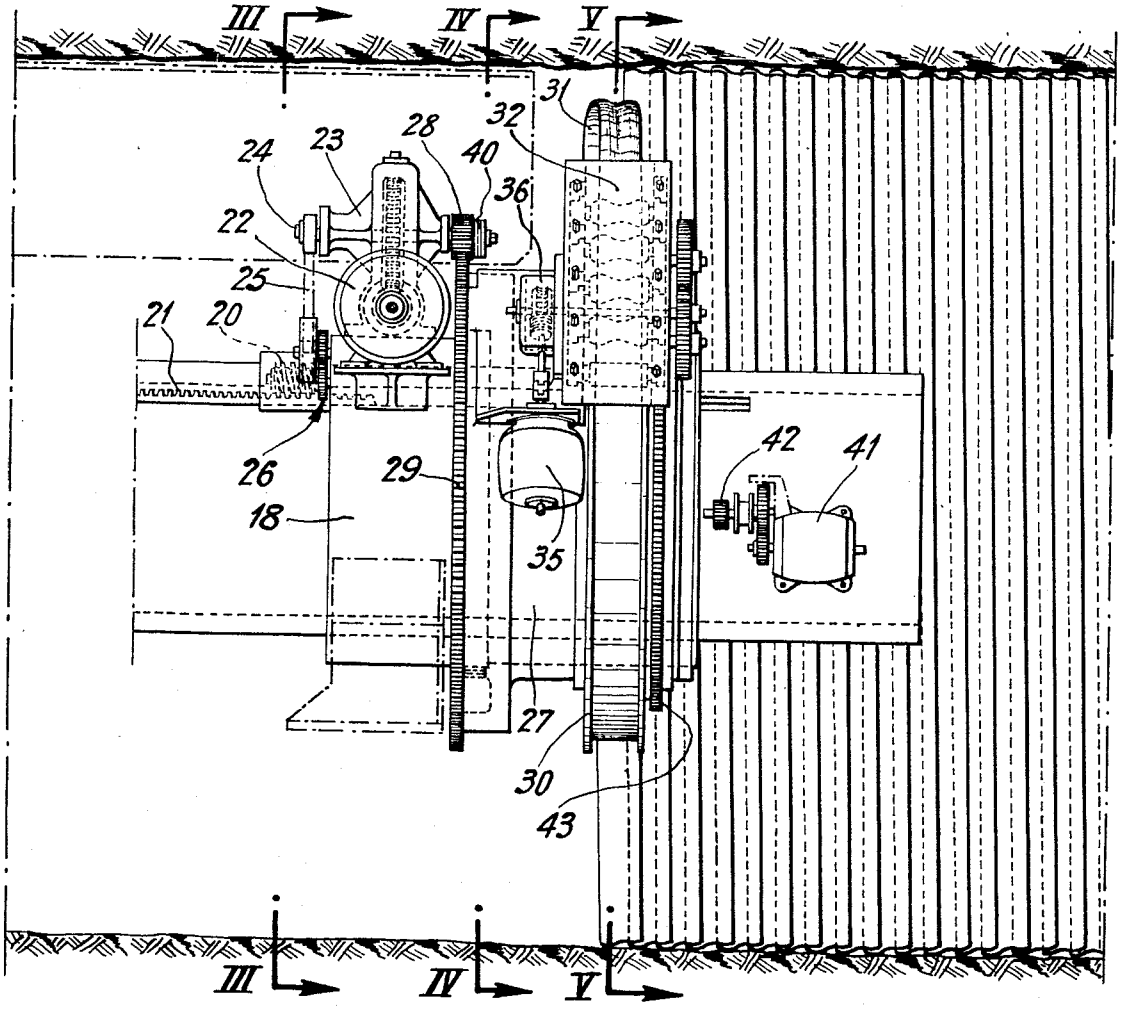
FIG. 2 is a more detailed view of the mechanism for positioning lining, of the machine of FIG. 1, FIGS. 3, 4 and 5 are cross sections on the lines III—III, IV—IV and V—V respectively of FIG. 2.
Figure 3:
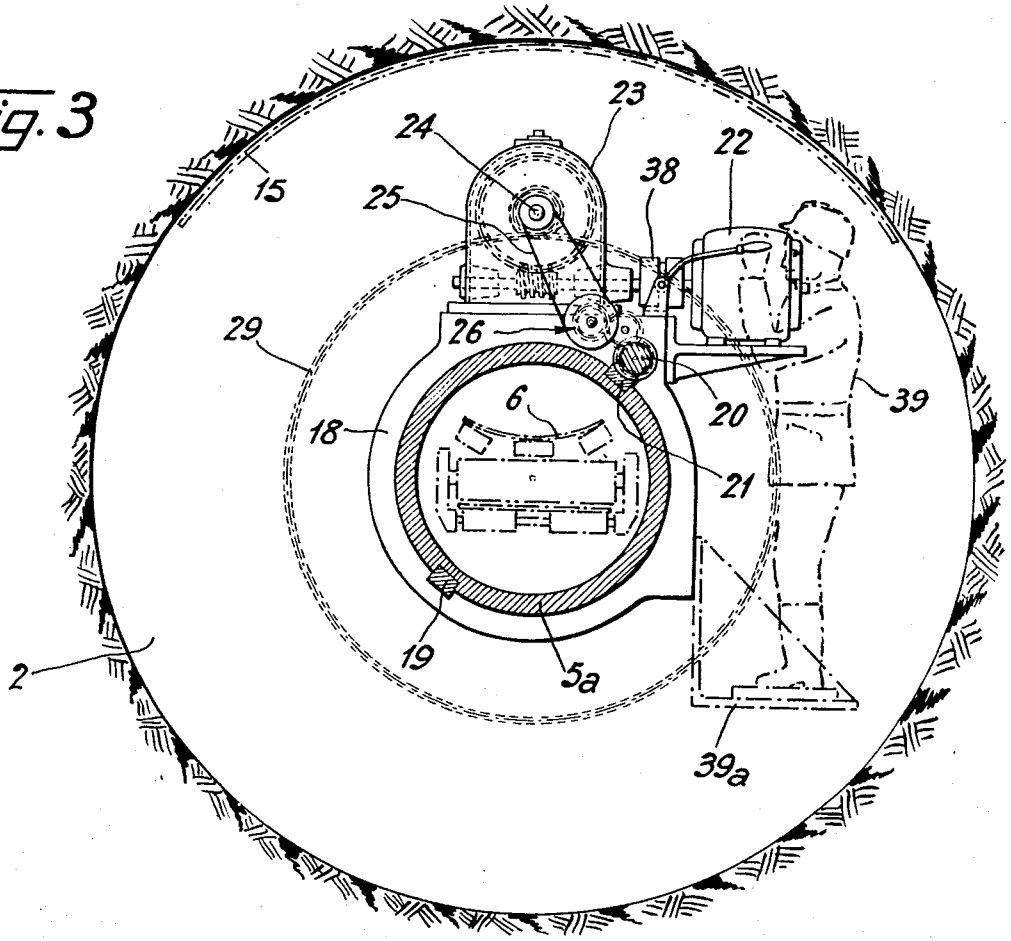

Machine 1, embodying the invention and shown in FIG. 1, is for driving a tunnel 2 of substantially circular section and having a substantially cylindrical wall. For this purpose, the machine has at its front a digging head 3, attacking a cutting face 4 over all of the cross-section of the tunnel. This type of machine is called a "full face" machine. As will be apparent from the following description, the present invention is not limited to this type of machine.

The machine further includes an elongate tubular structure 5, axially hollow and within which a continuous conveyor 6 is arranged. Spouts 7 direct the spoil from the digging head 3 in known fashion onto the front end of the conveyor 6 and this then carries the spoil behind the machine 1.

The digging head 3 is rotatably mounted relative to a slider 8 which can slide but not turn relative to the tubular structure 5, the axes of the head 3 and of the structure 5 being identical. The slider 8 is fastened by rams 9 to a plurality of longitudinal rams with double-acting cylinders distributed on a ring 10, fastened in the middle or center portion of the structure 5. Moreover the ring 10 includes peripheral radial rams 11 which are provided with bearing pads 12 at their ends. The slider 8 includes also peripheral radial rams 13 which are provided with bearing pads 14 at their ends.

It can be readily seen how upon appropriate control of the rams 9, 10, 11 and 13, the machine 1 can progress in the tunnel 2, caterpillar-like, in pace with the excavation of the tunnel, by bearing alternately on the pads 12 and pads 14. The rams 9 press the slider 8 against the digging head 3 which then presses against the cutting face 4 when the pads 12 are bearing on the wall of the tunnel. When the rams 9 are about fully extended, cutting may be stopped, rams 13 activated to place pads 14 against the tunnel walls and rams 11 retracted to withdraw pads 12 from contact with the tunnel wall. The cylinders joined to rams 9 are activated to then move the ring 10 in the direction of the tunnel face.

In order to avoid collapse of the top wall of the tunnel 2 onto the machine 1, this has a shield 15 fixed to the slider 8 by stays 16.

According to the present invention there is mounted on the rear portion **5*a* of the structure 5 a mechanism 17 for putting into position, immediately behind the shield 15, a lining formed of a flexible metal band, disposed helically and applied against the substantially cylindrical wall of the tunnel 2**.

This mechanism 17 (see FIGS. 2 to 6) includes a slider 18, in the form of a sleeve concentric with the rear portion **5*a* of the structure 5. The slider 18 can slide but not turn about the axis of the said portion 5*a*. For this purpose a spline 19 is provided to block any rotation about the common axis of the structure 5 and of the slider 18, while a worm 20 meshing with a rack 21** can cause longitudinal displacement of the slider.

The rack 21 is fixed on the rear portion **5*a* of the structure 5, parallel to the longitudinal axis of the latter. The worm 20 mounted on the slider 18 to be rotatable about its own axis is driven by a motor 22 through a speed-reducer 23. The motor 22 and speed-reducer 23 are carried by the slider 18. A drive linkage between a shaft 24 of the speed-reducer 23 and the worm 21 is assured by a chain 25 and pinions 26. Interchangeable sets of pinions 26 allow the speed of rotation of the worm 20** to be adjusted.

On the slider 18 there is rotatably mounted a rotor 27, like slider 18 in the form of a sleeve and concentric with it and with the structure 5. The rotor 27 can be rotated about the common axis of these various members 5, 18, 27 by a pinion 28 also keyed onto the shaft 24 of the speed-reducer 23 and meshing with a toothed ring 29 which is fast with the said rotor. The latter carries on the one hand a freely rotatable reel 30 on which is wound a sheet metal band 31 in the form of a coil and on the other hand an ejector 32 fast with the said rotor. The ejector 32 includes a plurality of pairs of cooperating rollers 33, 34 at least some of which drive and at least some of which form the band 31 passing between them.

For this purpose, the rollers of the pairs 33, 34 are driven from an electric motor 35, through a speed-reducer 36. The motor 35 is fast with the rotor 27 and is fed in known manner by slip brushes. The spacing apart of the rollers 33 and 34 of each pair can be adjusted in accordance with the thickness of the band 31, (see FIG. 6).

Figure 4:
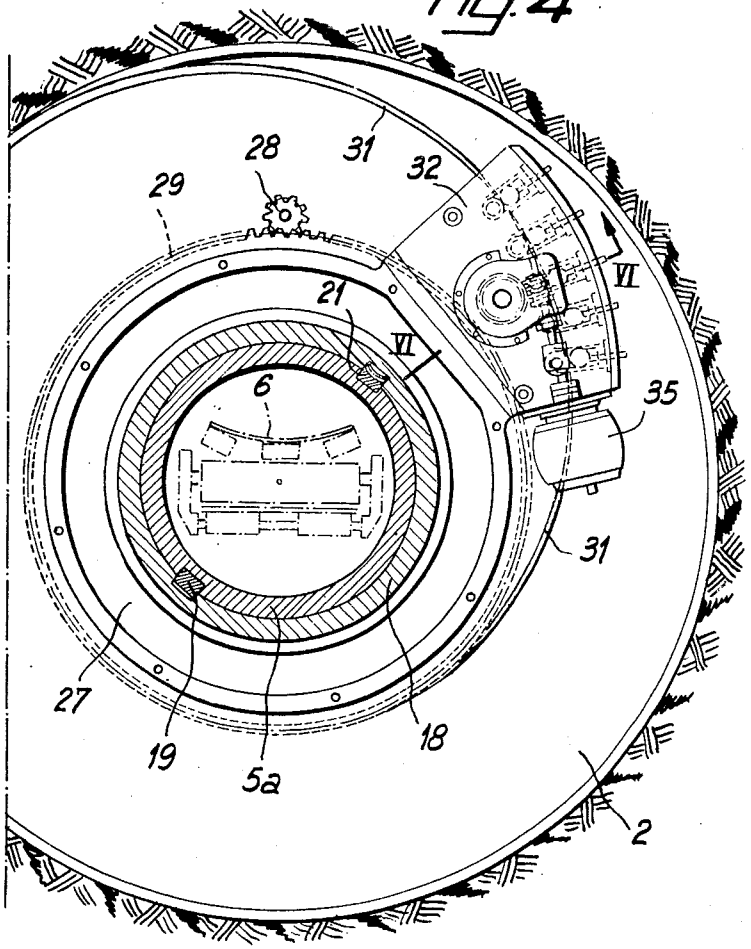
Figure 5:
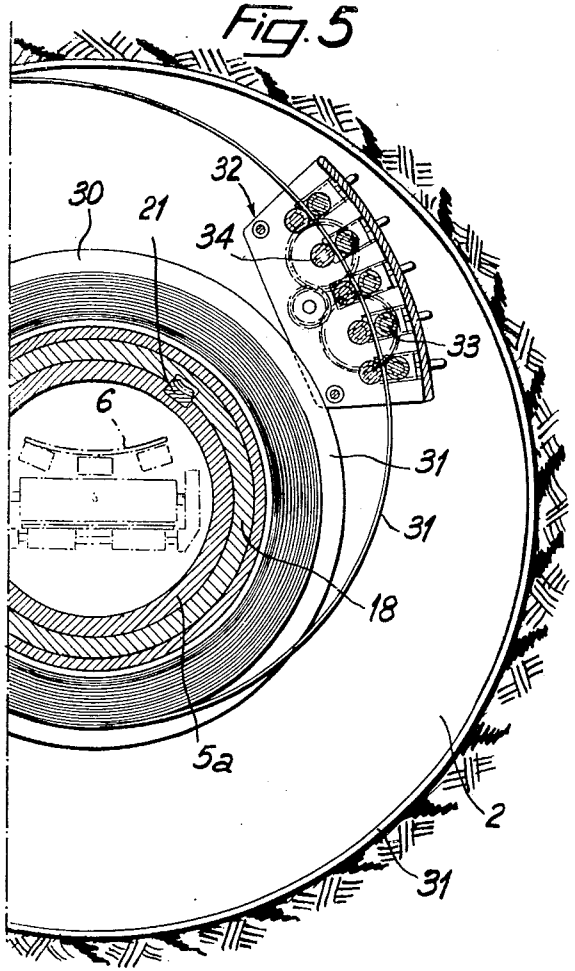

The various pairs of rollers 33, 34 define a curved path for the metal band 31 so as to impose on the band between the reel 30 and the place where it bears on the wall of the tunnel, the form of an arc 37 lying in a plane normal to the axis of the structure 5 and substantially tangential at its ends, to the said reel and to the said wall respectively (see FIG. 4). The speed of the shaft 24 of the speed-reducer 23 gives the rotor 27 a speed of rotation which is chosen to have a direct relation to the overall speed of penetration of the machine 1 in the ground. A clutch system 38 (see FIG. 3) is positioned between the motor 22 and the speed-reducer 23 to allow the operator 39 of the machine 1 (mounted on a running board **39*a* fast with the slider 18) to adjust the speed of rotation of the rotor 27, therefore that of the ejector 32, and the speed of slide of the slider 18 along the structure 5 as a function of the actual progress made by the digging head 3 into the cutting face 4**.

The tangential speed of the rotor 27 is slightly less than the peripheral speed of the drive rollers 33 or 34 so that the band is continuously pressed against the wall of the tunnel 2.

A friction system 40 is associated with the pinion 28 so that in the event of accidental blockage in the feeding of the ejector 32 with the band 31 damage will be avoided.

The rotor 27 is rotated at an angular speed and slid longitudinally by slider 18 on the structure 5 at a linear speed such that the overall rate of progress of the tunnelling machine 1 is matched in the application of the helical winding to the wall of the tunnel. For example, as the structure 5 advances (to the left in FIGS. 1 and 2) as a result of excavation of the cutting face 4 by the head 3, the operator 39 controls the sliding of the slider 18 (to the right relative structure 5) and the rotation of the rotor 27 in relation to the speed of advance so that the band 31, ejected in the direction of the wall of the tunnel 2 forms a helical winding against that wall. The turns of this winding can be in contact, one with the next, or not according to the adjustment selected by the operator. A reverse (not shown) mounted on the motor 22, allows the slider to return drawn back along the structure 5, as necessary. The system 40 disengages drive from the pinion 28 and hence from ring 29 when the direction of drive of the motor 22 is reversed.

The rear end of the portion **5*a* of the structure 5 carries an electric motor 41 adapted to drive a pinion 42. This latter comes into engagement with a toothed ring 43, fast with the reel 30, when the slider 18 is in its rear most position. The reel 30 can then be turned in the appropriate sense, when it is empty, to reload it with a further amount of band 31 from a feed reel 44, brought along the tunnel on a trolley 45 (see FIG. 7). Between the feed reel 44 and the reel 30 to be reloaded, the band 31 can be guided by pulleys 46 and pads 47**.

The reloading of the reel 30 with band 31 can therefore be done without stopping the digging head 3.

The band 31 when wound on the reel 30 can be planar in cross section and can be formed by the rollers 33, 34 as it passes between them. FIGS. 8*a*, 8*b* and 8*c* show examples of wavy, chanelled orribbed cross-sectional profiles which can be imposed on the band 31. Moreover this band can be imperforate or can be provided with apertures 48, whether ribbed or not, as seen in FIGS. 9*a* and 9*b*.

We thus see therefore how the machine described allows total protection of the people working in the tunnel, the helical winding being able to be positioned very close to the shield of the machine; continuous working, practically without stopping the progress of the digging head and hence a considerable reduction in the cost price of tunnel excavation.

Furthermore, while the walls of tunnels excavated in this way may subsequently have to be faced with concrete, this may be poured directly onto the helical winding which would then serve as reinforcement.

If necessary it is possible to rigidify the sheet metal helical winding in place by welding its turns one to the next, e.g. by spot-welding.

I claim:

1. Tunnelling and lining machine for forming a tunnel with a substantially cylindrical wall, the machine having a rear end and a front end, a longitudinal axis extending between the rear end and front end, and a structure extending between the rear end and front end, a hollow center of the structure accommodating conveyor means for conveying material longitudinally along the structure, a digging head at the front end of the structure for cutting the working face of the earth to be tunnelled, and means mounting the digging head on the structure, a rotor mounted concentric with the structure behind the digging head to be rotatable about the longitudinal axis of the structure, the means mounting the rotor concentric with the structure comprising a slider, means mounting the slider on the structure for longitudinal displacement therealong, with forward and rearward limit positions of such displacement, and drive means for driving the slider in said longitudinal displacement, drive means for driving the rotor in rotation, and the rotor comprising means for feeding outwardly towards the wall of the tunnel a flexible band of material to form a helical winding form from the band contiguous to the substantially cylindrical wall of the tunnel.

2. Tunnelling and lining machine as claimed in claim 1 wherein the said drive means for said longitudinal displacement of said slider and said drive means for said rotation of said rotor comprise a common prime mover borne on the slider and respective drive trains from said common prime mover.

3. Tunnelling and lining machine as claimed in claim 1 wherein the means for feeding the flexible band outwardly comprises a reel mounted on the machine and having an axis of rotation parallel to that of the rotor, the reel holding a spiral of said band material, an ejector on the rotor, at least one pair of rollers in the ejector, a nip between the rollers of the at least one pair of rollers, the at least one pair of rollers adapted to receive the band tightly in its nip, the rollers comprising at least one drive roller, means for driving the at least one drive roller, whereby the band may be drawn from the reel and ejected outwardly from the ejector towards the wall of the tunnel.

4. Tunnelling and lining machine as claimed in claim 3 wherein the at least one pair of rollers of the ejector comprise at least one forming roller adapted to impose a predetermined cross-sectional profile on the band received in its nip.

5.. Tunnelling and lining machine as claimed in claim 1 wherein the means for feeding the flexible band outwardly comprise a reel adapted to receive a spiral winding of the band, the reel having an axis of rotation identical with that of the rotor, means mounting the reel rotatably about its axis of rotation on the slider, a drive means for the reel including a prime mover stationary on the structure, a drive train of the said drive means being engageable between the prime mover and the reel only when the slider is at a said limit position of its longitudinal displacement.

6. Tunnelling and lining machine as claimed in claim 1 wherein the means for feeding the flexible band outwardly comprise a reel adapted to receive a spiral winding of the band, the reel having an axis of rotation identical with that of the rotor, means mounting the reel rotatably about its axis of rotation on the slider, and drive means actuable on the reel adapted to drive it in rotation in a sense opposite to that in which the reel rotates to feed material of the band towards the said wall.

7. Tunnelling and lining machine as claimed in claim 2 wherein the drive train of the drive means effecting longitudinal displacement of said slider includes a multiple-ratio transmission.

8. Tunnelling and lining machine for forming a tunnel with a substantially cylindrical wall, the machine having a rear end and a front end, a longitudinal axis extending between the rear end and front end, a structure extending between the rear end and front end a hollow center of the structure accommodating conveyor means for conveyor material longitudinally along the structure, a digging head at the front end of the structure, for cutting the working fence of the earth to be tunnelled, and means mounting the digging head on the structure, a rotor mounted concentric with the structure behind the digging head to be rotatable about the longitudinal axis of the structure, drive means for driving the rotor in rotation, the rotor comprising means for feeding outwardly towards the wall of the tunnel a flexible band of material to form a helical winding from the band contiguous to the substantially cylindrical wall of the tunnel, the means for feeding the flexible band outwardly comprising a reel mounted on the machine for receiving a spiral winding of the material of said band and having an axis of rotation parallel to that of the rotor, an ejector on the rotor, at least one pair of rollers in the ejector with a nip between the at least one pair od rollers, the at least one pair of rollers being adapted to receive the band tightly in its nip, the rollers comprising at least one drive roller and means for driving the at least one drive roller whereby the band may be drawn from the reel and ejected outwardly from the ejector towards the wall of the tunnel, and the said means for driving the at least one drive roller and the drive means for driving the rotor in rotation are arranged to drive the said roller at a peripheral speed slightly greater than the tangential speed of the rotor in rotation.

* * * * *